United States Patent [19]

Farrow

[11] 4,072,102

[45] Feb. 7, 1978

[54] FLUID APPLYING PLATE

[75] Inventor: Harold Frederick Farrow, Hitchin, England

[73] Assignee: Colorflo Limited, Hitchin, England

[21] Appl. No.: 736,568

[22] Filed: Oct. 28, 1976

[30] Foreign Application Priority Data

Nov. 20, 1975 United Kingdom ..... 47832/75

[51] Int. Cl.[2] ..... B41F 3/36; B41F 1/40

[52] U.S. Cl. ..... 101/151; 101/163

[58] Field of Search ..... 101/150, 163, 164, 171, 101/151, 114, 115

[56] References Cited

U.S. PATENT DOCUMENTS

| | | | |
|---|---|---|---|
| 2,656,570 | 10/1953 | Harmon et al. | 101/170 X |
| 3,403,621 | 10/1968 | Simson et al. | 101/415.1 |
| 3,696,745 | 10/1972 | Morton | 101/415.1 |
| 3,896,722 | 7/1975 | Farrow | 101/127.1 X |

FOREIGN PATENT DOCUMENTS

| | | | |
|---|---|---|---|
| 1,396,282 | 6/1975 | United Kingdom | 101/150 |

*Primary Examiner*—J. Reed Fisher

[57] ABSTRACT

Apparatus for depositing fluid on a substrate in a predetermined design. A two-part die assembly is used in the apparatus and includes a die plate and a feed plate bonded together having at least one lateral fluid distribution channel therein. The die plate has a recess in a first surface thereof corresponding with the predetermined design and passage means therethrough connecting a second surface thereof with said recess to deliver fluid into said recess. The feed plate bonded thereto also has passage means therethrough to deliver fluid into said passage means of the die plate. The two-part die assembly is adapted to be releasably secured to a support means by, preferably, double-sided adhesive tape.

9 Claims, 5 Drawing Figures

FLUID APPLYING PLATE

This invention relates to printing apparatus and is an improvement in a modification of the invention forming the subject of United Kingdom Pat. No. 1,396,282.

The apparatus with which the invention is particularly concerned is for intaglio printing in which the material to be printed e.g. ink, paint, adhesive, or like printing liquid, is forced through the thickness of the intaglio printing plate. With such apparatus it has been proposed to provide one or more distribution channels on the back of the printing plate each channel communicating through the plate with differing parts of the recessed design on the printing surface of the plate. If differently coloured printing material is fed into different channels then the parts of the design to be printed which communicate with these channels will be printed in the different colours (such apparatus will hereafter be referred to as "printing apparatus of the type described").

As the ink or the like is normally fed to the plate under pressure problems arise in sealing the channels on the back of the plate both to prevent leakage of ink of one colour from one channel to another containing ink of a different colour, and from the confines of the back surface of the plate.

This problem is effectively solved or minimised by the use of at least one gasket plate which in accordance with the invention of Pat. No. 1,396,282 and which in use is located behind the printing plate and is formed with a pattern of resilient ribs corresponding with ink distribution channels either in the back of the plate with which the gasket is to be employed, or in a separate distributor plate located above the printing plate, each rib which is formed with one or more holes passing through it to allow ink or the like to pass therethrough, engaging, during use a channel in the distribution or printing plate and sealing against the sides of the channel.

However, such a gasket plate has the disadvantage that a resilient gasket with ribs provided thereon must be specially molded for each individual intaglio die plate. That is, each time an intaglio die plate is created for printing fluid in a new predetermined design, a mating resilient gasket must be molded therefor.

It is the general object of the present invention to further simplify the seal between the fluid injector unit and an intaglio die plate having lateral fluid distribution channels.

It is a further object of the present invention to provide a die assembly which can be easily constructed and which can be releasably secured to the support means for the fluid injector units, so that intaglio die plates having a different predetermined designs will interchangeably fit the support means for the fluid injector.

The present invention broadly contemplates a two-part die assembly comprising a feed plate and a die plate which are relatively permanently bonded together, the two-part die assembly being releasably secured to a support means for a plurality of fluid injectors. The lower surface of the die plate has a recess therein corresponding with any desired or selected design; passage means are provided in the die plate for providing fluid communication between the first or lower surface and a second or upper surface. A planar, rigid feed plate is bonded to the die plate and has a lower or first surface which is free of any projections therefrom and which is adhesively bonded to the upper or second surface of the die plate so that a two-part die assembly is formed. Passage means are also provided in the feed plate for fluid communication therethrough from the outlet ports of the fluid injectors into the passage means in the die plate. Lateral distribution channels or grooves acting as a type of manifold are provided for distributing the fluid from one or more fluid injectors into various recesses to insure complete and proper fluid distribution. The lateral distribution channels or grooves may be provided in either the lower or first surface of the feed plate, or the upper or second surface of the die plate.

A preferred embodiment of apparatus in accordance with the invention will now be described with reference to the accompanying drawings in which.

Figure 1:
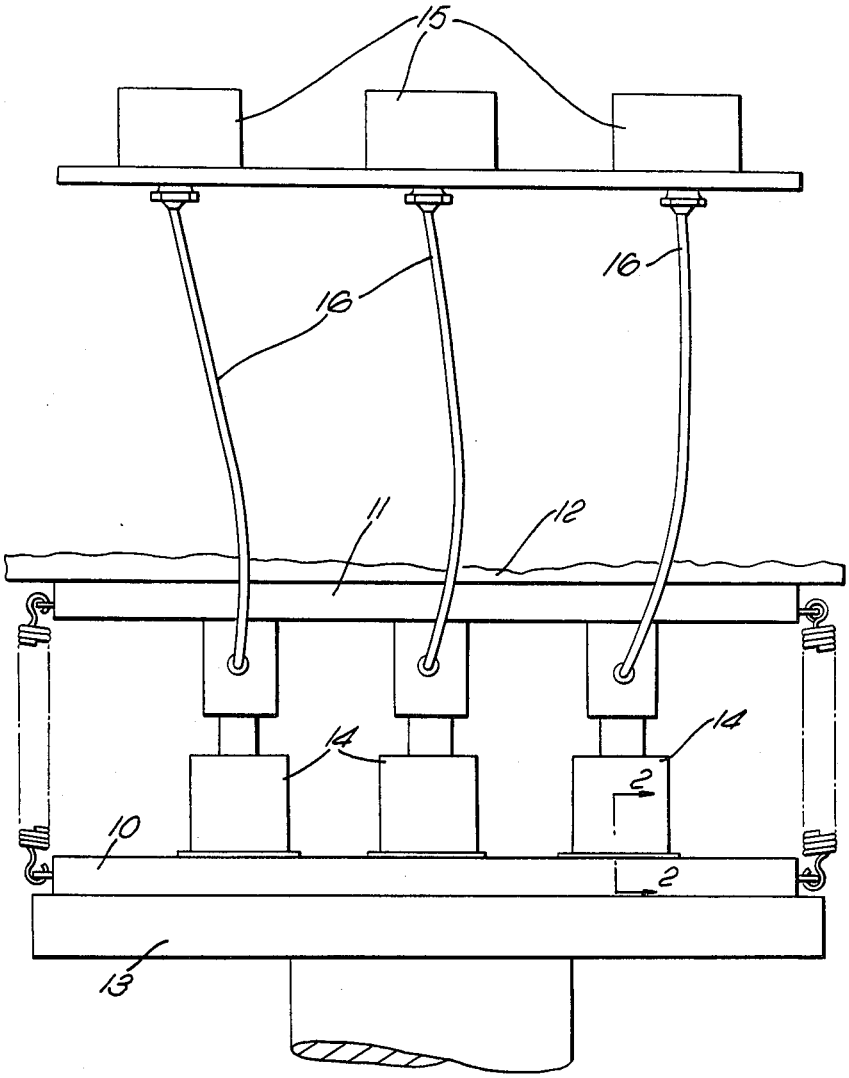
FIG. 1 is a schematic elevation of the intaglio printing apparatus.

Referring to FIG. 1, die plate construction 10 which is designed for printing a predetermined pattern is supported from an upper support plate 11 mounted on an upper press platen 12. The press platen 12 cooperates with a lower press platen 13 onto which the sheet or substrate to be printed is placed. In the specification, the material to be printed will be described as a sheet of paper or substrate with the understanding that the invention is applicable to any material to be printed with a design whether or not in sheet form or of paper, such as a gasket.

Figure 2:
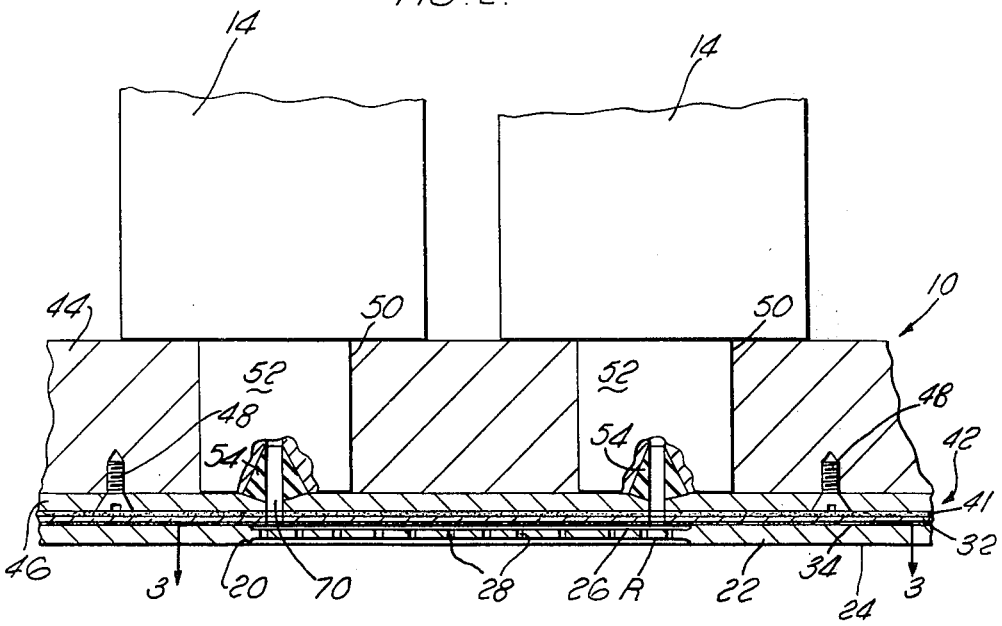
FIG. 2 is a view partly in cross-section and partly in elevation taken along line 2—2 of FIG. 1.
Figure 4:
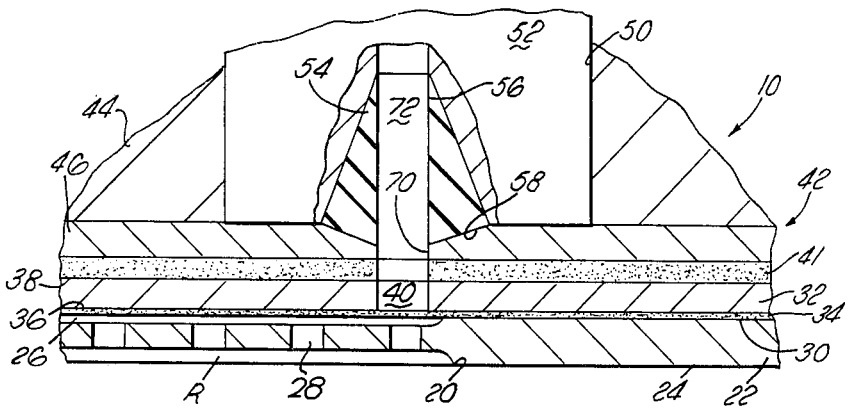
FIG. 4 is an enlarged fragmentary view of a portion of FIG. 2 showing a seal and the various elements in the die plate construction of the present invention.

In the apparatus of FIG. 1, paint, or other printing fluid being deposited, is injected through the die construction 10 by a plurality of fluid injector units 14, three of such units being illustrated in the drawings for printing three different colors. The injector unit illustrated is particularly suitable for simultaneously printing a multitude of colors onto a sheet. Each injector unit 14 supplies printing fluid to one or more intaglio recesses R, as best seen in FIGS. 2 and 4. Each recess R has an outer perimeter and corresponding edge 20 which seals against the substrate to be printed.

The injector units 14 are each supplied from a corresponding printing fluid reservoir 15. Each injector unit 14 is connected to a corresponding one of the reservoirs 15 by a flexible conduit 16 which conducts printing fluid from the reservoir to the inlet of the injector. While the reservoirs 15 may be under pressure, preferably the feed from the reservoirs is a gravity feed.

Preferably, the fluid injector units 14 are a piston type fluid injector unit as more thoroughly described in U.S. Pat. No. 3,896,722, which is hereby incorporated by reference. As represented therein and herein, the drawings illustrate the present invention as applied to an engraving operation and the description hereinbelow will be made in that context. It should be understood, however, that there is no intent to limit the present invention to purely an engraving use.

In the type of apparatus such as intaglio printing apparatus to which the present invention relates, the fluid injector units 14 are located between engraved die plate 22, which is part of the die construction 10, and one of two cooperating press platens, 12 and 13, preferably the upper press platen 12, so that when the press platens are moved toward each other to effect deposition of the fluid, the injector units 14 are contracted to pump fluid into the recesses R in the die plate 22. The platens are moved toward each other to engage the die plate 22 with a substrate onto which the fluid is to be deposited to establish a pressure and to effect a contraction of the fluid injector units to pump fluid through the die plate 22 into the recesses R in the first or lower surface 24 of the die plate 22. Preferably, the arrangement is such that a sealing pressure is established before the injector units are contracted sufficiently to inject fluid into the recesses R. The establishment of a sealing pressure causes the seal to be effected between the substrate onto which the design is to be printed and the edges 20 of the recesses R forming a part of the predetermined design. This seal is for preventing fluid from flowing out of the recesses R. Since the contraction of the injector units will cause the fluid to be supplied under pressure, it is important that the injector units supply the proper quantity of fluid under a pressure which is controlled so that the seal between the substrate and the die is not broken and so that the fluid will not be splattered to other areas of the substrate.

The die construction 10 of FIG. 1 is more clearly illustrated in FIG. 2 and the enlarged view of FIG. 4. With reference thereto, die plate 22 has recesses R therein in a selected, predetermined design. As noted above, the outer perimeter of the recess or any self-contained portion thereof has an edge 20 for sealing engagement between the die plate 22 and the substrate to be printed. The substrate to be printed contacts the lower or first surface 24 of the die plate 22. The die plate 22 has passage means therein for transmitting the printed fluid from the fluid injectors 14 into the recesses in the lower or first surface 24. In the embodiment detailed in FIGS. 2 and 4, the passage means comprises lateral distribution grooves or channels 26 which are in fluid communication with the recesses by means of vertical character bores 28.

The upper or second surface 30 of the die plate 22 is bonded to feed plate 32 by adhesive means 34. Preferably, adhesive means 34 effects a relatively permanent bond between the feed plate 32 and the die plate 22, so that a two-part die assembly is formed. A relatively permanent bond permits the two-part die assembly to constitute a single unit which may be detachably removed in a simple fashion from the support means for fluid injector units 14 for cleaning and storage purposes. If a relatively permanent bond is formed by adhesive means 34, the two-part die assembly can be cleaned with strong cleaning solvents and otherwise handled without effecting any separation between the feed plate 32 and the die plate 22. In this fashion, the passage means in the feed plate 32 and the die plate 22 can be thoroughly cleaned.

Feed plate 32 has a lower or first surface 36 which contacts the adhesive means 34 and an upper or second surface 38. The passage means in feed plate 32 comprises a series of bores 40 for transmitting printing fluid from the fluid injectors 14 into the distribution groove 26 of die plate 22. Since feed plate 32 is designed to be a permanent element of the two-part die assembly, bores 40 are provided in aligned locations between the particular lateral distribution grooves 26 of die plate 22 and those selected fluid injector units 14 which are necessary for a particular printing operation. In this manner, a complete matrix of fluid injectors 14 can be employed in all printing operations so that a uniform press pressure is obtained. However, the bores 40 in feed plate 32 are drilled in only those locations necessary for the predetermined design of a particular printing operation. As is well known in the art, the shape and number of distribution grooves 26 and the bores 28 and 40 are determined according to well-known criteria in accordance with the pre-selected design formed by the recesses R.

It is important for efficient operation that the fewest number of injectors be used. Feed plate 32 performs the important function of preventing the fluid under pressure in the fluid distribution grooves 26 from flowing back up into dummy injectors.

The upper or second surface 38 of feed plate 32 is in turn releasably secured to support means 42. As illustrated in FIGS. 2 and 4, support means 42 comprises a main support plate 44 and a sub-support plate 46. Sub-support plate 46 is attached to main support plate 44 by any suitable means, such as by flat-head screws 48.

The two-part die assembly comprising the feed plate 32 and the die plate 22 is releasably secured to the support means 42. In the preferred embodiment of FIGS. 2 and 4, the detachable bond is achieved by double-sided adhesive tape illustrated by designation 41. Although any suitable mechanical means could be employed for detachably securing the two-part die assembly to the support means 42, a type of cement, glue, adhesive, or tape is preferred to prevent any cross mixing of fluids by way of leakage between the support means 42 and the upper or second surface 38 of feed plate 32 or alternatively the two-part die may be secured to the support 42 magnetically. Most preferably, double-sided adhesive tape 41 is employed so that it may be easily and conveniently applied to the two-part die assembly without blocking the flow of fluid through bores 40. The latter consideration is important since once the two-part die assembly is secured to the support means 42, detection and elimination of any blockage of bores 40 is difficult. Thus, the double-sided adhesive tape 41 together with the two-part die assembly provide the functions of preventing lateral bleeding between the support means 42 and the two-part die assembly.

In the embodiment of FIGS. 2 and 4, the support means 42 comprises a sub-support plate 46 secured to the main support plate 44, but the support means 42 could also be manufactured such that the main support plate 44 and the sub-support plate 46 were one integral plate. Support means 42 is provided with cylindrical bores 50 which extend through only a portion thereof. In the embodiment shown in FIGS. 2 and 4, the cylindrical bores 50 extend completely through the main support plate 44 but not through the sub-support plate 46.

Sealing engagement between the fluid injectors 14 and the support means 42 is provided by a series of nubs 54 secured to the base of the cylindrical bore 50, which in FIGS. 2 and 4 is the upper surface of sub-support plate 46. Each nub 54 is preferably formed of a resilient material such as rubber or other suitable plastic and is shaped in the form of a truncated cone. The protuberance 52 of fluid injector 14 contains a correspondingly mating surface 56 in the shape of a truncated cone to engage the surface of nub 54. The nubs 54 may be secured in counter-sunk surface 58 in the sub-support plate 46 in any suitable fashion.

Figure 5:
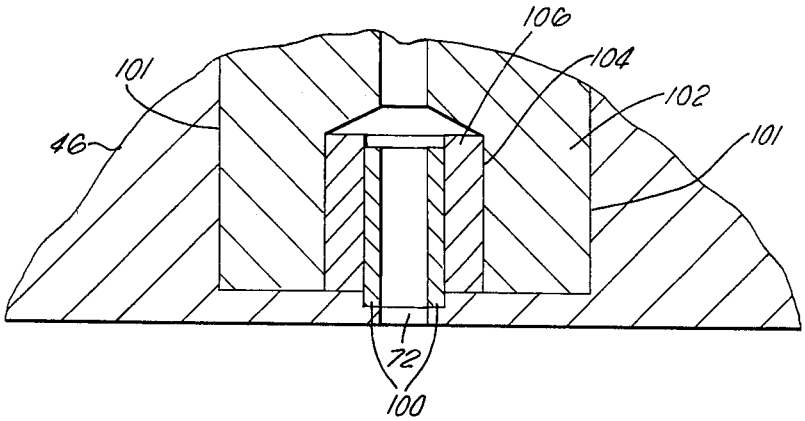
FIG. 5 is a section of an alternative means of providing a seal between the die plate construction and the injector units.

Alternatively and preferably the sealing arrangement shown in FIG. 5 may be used. In this embodiment a brass tube 100 is hand soldered in a counter bore 101 in the plate. The bottom surface 102 of the injector has a counter-bore 104 in which is secured a nylon sleeve 106 into which the tube 100 is a good push fit. Thus the injectors may be pushed down with their protuberances 102 pushed into the counter-bores 101 and the sleeves 106 pushed over the tubes 100.

Figure 3:
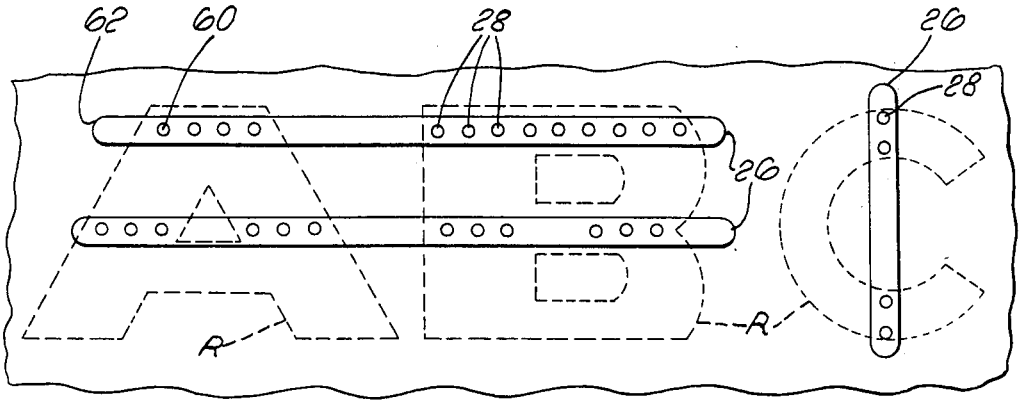
FIG. 3 is a fragmented plan view taken along the line 3—3 of FIG. 2.

Shown in FIG. 3 is a fragmented plan view of the die plate 22 with recesses R shown in phantom. As noted above, for a particular predetermined design (ABC), one skilled in the art can easily determine the number of fluid distribution grooves 26 and the number of character feed bores 28 which would be required for proper flow of the fluid therethrough and into the recesses R. Thus, it is preferred that distribution channel 26, illustrated by designation 62 in FIG. 3, should extend the least possible difference beyond the last feed bore 60.

The die plate 22 and the feed plate 32 can be formed of any metal, such as steel, copper, brass, or magnesium, sufficiently hard and strong to be hand or machine engraved and to withstand the printing pressure. Any suitable plastic can also be employed in the die plate or feed plate so long as it is not attacked by the printing fluid and so long as it is sufficiently hard and strong to be hand, machine or photo/wash engraved and to withstand the printing pressure. Brass and copper are preferred, copper especially being preferred for the die plate 22.

The recess in the die plate 22 may be formed by any suitable engraving process. For example, the recess R may be formed by photoengraving the recess in the lower or first surface 24 thereof. The fluid distribution channels 26 may also be suitably formed in the second or upper surface 30 of die plate 22, such as by photoengraving. Character feed bores 28 are then drilled to place the fluid distribution channels 26 in fluid communication with recess R. Alternatively, the fluid distribution channels 26 may be formed in the lower or first surface 36 of the feed plate 32 in order to give the die plate 22 more structural strength and stability.

As shown in FIG. 3, the sidewalls of the distribution channel 26 do not require an included angle, such as about 30 to 40 degrees as is required in the embodiment described in U.S. Pat. No. 3,896,722. Because of that included angle, the fluid distribution channels cannot be photoengraved therein. Furthermore, proper operation of the apparatus therein requires that the fluid distribution channels be of a greater depth than those of the present invention. For example, one die plate manufactured according to the above patent required fluid distribution channels having a 0.090inch (0.228 cm) depth necessitating that the thickness of the copper die plate be 0.125inch (0.3175 cm). However, die plate 22 according to the present invention need only be about 0.035 inch (0.0889 cm) in the thickness, having fluid distribution channels about 0.005 to 0.012 inch in depth. Since copper is a very difficult metal to drill, the thinner die plate of the present invention provides a great manufacturing advantage. Furthermore, the elimination of the included angle of the fluid distribution channels 26 of the present invention provide easy manufacturing, whereas the included angle of the distribution channels of the above patent require expensive machinery to accomplish the necessary routing.

Additionally, the fluid distribution channels 26 of the present invention can be narrower than those of the above patent, permitting fluid distribution into very fine predetermined designs. Furthermore, the two-part die assembly of the present invention can be manufactured much more quickly than a corresponding structure of the above patent, inasmuch as the formation of the resilient gasket for each die plate is eliminated. Thus, standard, interchangeable two-part die assemblies may be easily removed from the support means 42, which contains the sealing engagement by means of a series of nubs 54. In this manner, standardization of the sealing engagement is achieved for all die assemblies.

In forming the relatively permanent bond between the feed plate 32 and the die plate 22, the surfaces to be bonded should be suitably cleaned, such as by washing with MEK (methyl ethyl ketone) or by the method described hereinafter in connection with the example.

Any suitable adhesive, glue or cement can be applied between the surfaces to be bonded together. Preferred adhesive are heat-sealing lacquers, heat-accelerated two-part epoxy resins and synthetic rubber adhesives. If desired, the surfaces may be prepared by surface abrasion, such as contact with fine emergy paper. In order to prevent blockage of the fluid distribution channels 26, the adhesive should be applied to the corresponding mating surface, which in FIG. 4 is the lower or second surface 36 of feed plate 32. The adhesive is advantageously applied by a draw down device, which is a series of fine wires wrapped around a longitudinal rod having a handle at one end thereof. Once the two plates are bonded together, the bores 40 in the feed plate 32 can be redrilled, and thus, only minimal amounts of the adhesive are formed in the distribution channels 26.

As described above, the adhesive means for bonding the die assembly to the support plate is preferably double-sided adhesive tape 41. The double-sided tape may be applied to either the support means 42 or to the feed plate 32, naturally removing the portions of tape in the areas through which the fluid is to flow from active injectors 14.

A preferred form of the present invention and a method of manufacture therefor will now be described. A copper die plate 8½inch (21.6 cm) × 3½inch (8.9 cm) × 0.035 inch (0.0889 cm) was engraved with O and A characters considered to give a pattern having poor feed conditions to the characters and fluid distribution channels. The fluid distribution channels were 1/16 inch (0.159 cm) in width and 0.005 inch to 0.012 inch in depth. A brass feed plate was also provided having dimensions identical to the die plate with the exception that the thickness was only 0.020 inch (0.05 cm). The bores 40 in the feed plate 32 were 0.050 inch (0.127 cm) in diameter. Dowel locations for aligning the feed and die plate onto the support means 42 were also provided.

The following preparation steps were then performed on the feed and die plates: first, dip for 3 minutes into a 10 weight/volume solution of ammonium persulphate; second, spray wash with water for 30 seconds; third, dip for 2 minutes in a degreasing solution of carbon tetrachloride; fourth, spray wash with water for 30 seconds; fifth, dip for 30 seconds in an 8% solution of hydrochloric acid; sixth, spray wash with water for 30 seconds; and seventh, dry in air.

A heat-sealing lacquer was then applied with a draw down device onto the lower surface 36 of feed plate 32. Next, the coating was allowed to air dry for about ten minutes after which the feed and die plate surfaces were mated and heated to 150° C at a clamping pressure of 2 to 3 tons. The plates were then allowed to cool in the air under the clamping pressure until a relatively permanent bond was achieved.

The holes 40 in feed plate 32 should be free of lacquer before bonding the two plates or alternatively, the above described procedure for redrilling the holes may be employed.

A double-sided adhesive tape was employed to secure the two-part die assembly to the sub-support plate 46. Test printing with three colours simultaneously was then effected. The test printings showed good impressions without contamination of colours across the distribution channels 26. The die and feed plates were split and rebonded several times to prove that no cross contamination was achieved. Furthermore, the thin, two-part die assembly gave good print results without bleed or ink starvation.

After removing the two-part die assembly employed in the first set of test printings, it was thoroughly cleaned and left overnight to dry. The two-part die assembly was then employed in a second set of test printings with results similar to the first set.

What we claim is:

1. Apparatus for depositing fluid on a substrate in a predetermined design comprising:

a die plate having a recess in a first surface thereof corresponding with said design;

a first passage means in said die plate connecting a second surface of said die plate with said recess to deliver fluid into said recess, said second surface being the opposite and parallel surface from said first surface of said die plate;

a planar, rigid feed plate having a first surface thereof which is free of any projections therefrom and which is adherently bonded to said second surface of said die plate to form a two-part die assembly;

a second passage means in said feed plate connecting a second surface opposite and parallel to said first surface of said feed plate to deliver fluid therethrough to said first passage means in said die plate without contacting said second surface of said feed plate;

a plurality of fluid injector units adapted for directing fluid into said second passage means in said feed plate for transmission into said recess;

support means for supporting said plurality of fluid injector units having a first surface thereof which is detachably bonded to said two-part die assembly and which is provided with a third passage means through which fluid flows from certain of said injectors; and at least one lateral fluid distribution channel formed in said two-part die assembly, each lateral fluid distribution channel being formed between said adherently bonded die and feed plates with said second surface of said feed plate blocking fluid flow back into other of said injectors.

2. Apparatus as claimed in claim 1 wherein said support means comprises a main support plate and a sub-support plate, said main support plate having a plurality of bores therethrough, each receiving a portion of a housing of each of said fluid injector units, and said sub-support plate having a plurality of projecting portions for sealing engagement with a corresponding opening in the housing of each of said fluid injector units.

3. Apparatus as claimed in claim 2 wherein the first passage means of said die plate comprises a lateral fluid distribution channel in said second surface thereof and a connecting passage for fluid communication between said recess and said fluid distribution channel, and the second passage means of said feed plate comprises openings therethrough in alignment with the opening in the housing of a fluid injector unit and in fluid communication to said fluid distribution channel.

4. Apparatus as claimed in claim 2 wherein the second passage means of said feed plate comprises a fluid distribution channel in said first surface thereof and a connecting passage for fluid communication between said fluid distribution channel and the opening in the housing of a fluid injector unit, and the first passage means of said die plate comprises opening connecting said fluid distribution channel to said recess.

5. Apparatus as claimed in claim 1 wherein said two-part die assembly is detachably bonded to said support means by double-sided adhesive tape.

6. Apparatus for use in a mechanism for depositing fluid on a substrate in a predetermined design which includes a fluid injector unit assembled with and in sealing engagement with a support means, said apparatus comprising:

a die plate having a recess in a first surface thereof corresponding with the design to be deposited on the substrate;

a first passage means in said die plate connecting a second surface of said die plate with said recess to deliver fluid into said recess, said second surface being the opposite and parallel surface from said first surface of said die plate;

a planar, rigid feed plate having a first planar surface thereof;

means bonding said first planar surface of said feed plate to said second surface of said die plate to form a two-part die assembly adapted for easy detachment from said support means, said bonding means blocking lateral flow of fluid between said feed and die plate surfaces;

a second passage means in said feed plate connecting a second surface opposite and parallel to said first surface of said feed plate to deliver fluid therethrough in certain areas to said first passage means in said die plate while blocking fluid flow back through said second surface of said feed plate in other areas; and at least one lateral fluid distribution channel formed in said two-part die assembly, each lateral distribution channel being formed between said feed plate and said die plate for fluid communication from said second passage means in said feed plate to said recess in said die plate, and said feed plate being free of any projections therefrom..

7. A die plate construction adapted for use with a plurality of injectors which receive fluid to be deposited on a substrate in a predetermined design, said die plate comprising a plate member having formed in one surface thereof recesses corresponding to said design, feed holes through a portion of said die plate communicating with said recesses, said feed holes communicating with a lateral distribution channel formed in the back of said die plate, a support plate for said injectors and having a plurality of openings through which fluid flows from said injectors, a feed plate interposed between said support plate and said die plate and having passages therethrough communicating with certain of said openings in said support plate for communicating fluid to said lateral distribution channel in said die plate, said feed plate having a surface portion blocking other of said passages through said support plate, adhesive means adhesively securing said feed plate and die plate together, and means for releasably securing said feed plate and die plate to said support plate.

8. A die plate construction as claimed in claim 7 wherein said support plate is provided with projecting portions effecting a seal between said support plate and said injectors.

9. A die plate construction as claimed in claim 7 wherein said lateral distribution channel has side walls substantially perpendicular to a bottom surface and a depth in the range from about 0.005 inches to about 0.012 inches.

* * * * *